US011846046B2

(12) United States Patent
Fang et al.

(10) Patent No.: US 11,846,046 B2
(45) Date of Patent: Dec. 19, 2023

(54) METHOD FOR PREPARING YARN WITH CLOUD DYEING EFFECT

(71) Applicant: FUJIAN HUAFENG NEW MATERIAL CO., LTD, Fujian (CN)

(72) Inventors: Huayu Fang, Fujian (CN); Daneshvar Kamran, Fujian (CN); Zhijian Fang, Fujian (CN); Yishu Lai, Fujian (CN); Yuxiang Chen, Fujian (CN)

(73) Assignee: FUJIAN HUAFENG NEW MATERIAL CO., LTD, Putian (CN)

( * ) Notice: Subject to any disclaimer, the term of this patent is extended or adjusted under 35 U.S.C. 154(b) by 411 days.

(21) Appl. No.: 17/211,868

(22) Filed: Mar. 25, 2021

(65) Prior Publication Data

US 2021/0207292 A1 Jul. 8, 2021

Related U.S. Application Data

(63) Continuation of application No. PCT/CN2018/087198, filed on Oct. 8, 2018.

(51) Int. Cl.

| | |
|---|---|
| ***D01D 1/00*** | (2006.01) |
| ***D02G 3/34*** | (2006.01) |
| ***D01D 1/06*** | (2006.01) |
| ***D01F 1/06*** | (2006.01) |
| ***D01F 1/10*** | (2006.01) |
| ***D01F 6/96*** | (2006.01) |
| ***D06M 15/643*** | (2006.01) |

(52) U.S. Cl.

CPC ..... *D02G 3/346* (2013.01); *D01D 1/065* (2013.01); *D01F 1/06* (2013.01); *D01F 1/10* (2013.01); *D01F 6/96* (2013.01); *D06M 15/643* (2013.01); *D10B 2401/14* (2013.01)

(58) Field of Classification Search

CPC ..... D02G 3/346; D01D 1/065; D01D 10/06; D01F 1/06; D01F 1/10; D01F 6/96; D06M 15/643; D10B 2401/14; D10B 2321/021; D10B 2321/022; D10B 2321/06; D10B 2321/10; D10B 2331/02; D10B 2331/021; D10B 2331/04

USPC ..... 8/483, 484, 485

See application file for complete search history.

(56) References Cited

U.S. PATENT DOCUMENTS

| | | | | |
|---|---|---|---|---|
| 6,019,799 | A * | 2/2000 | Brown | D06B 11/0023 8/151.2 |
| 6,120,560 | A * | 9/2000 | Miller | D06B 11/0059 8/149.1 |
| 6,312,783 | B1 * | 11/2001 | Radwan | D01F 6/46 264/210.8 |
| 6,413,632 | B1 * | 7/2002 | Pascoe | D06B 11/0023 428/364 |
| 6,811,574 | B2 * | 11/2004 | Baumann | D06P 3/24 427/430.1 |
| 7,651,540 | B2 * | 1/2010 | Rao | D06P 1/0096 8/654 |
| 7,674,302 | B1 * | 3/2010 | Weiner | D06P 5/22 8/483 |
| 8,167,958 | B2 * | 5/2012 | Meyer | D06P 3/003 8/918 |
| 2002/0133888 | A1 * | 9/2002 | Boyes | D06P 1/0096 8/483 |
| 2003/0064646 | A1 * | 4/2003 | Brown | D04B 21/04 428/364 |
| 2014/0053347 | A1 * | 2/2014 | Morton | D06P 1/0096 8/483 |
| 2014/0082859 | A1 * | 3/2014 | Morton | D06P 7/005 8/483 |

FOREIGN PATENT DOCUMENTS

| | | | |
|---|---|---|---|
| CN | 1403640 | A | 3/2003 |
| CN | 103215656 | A | 7/2013 |
| CN | 106400196 | A | 2/2017 |

OTHER PUBLICATIONS

International Search Report of PCT Patent Application No. PCT/CN2018/087198 dated Dec. 19, 2018.

* cited by examiner

*Primary Examiner* — Eisa B Elhilo

(57) ABSTRACT

The invention relates to the technical field of textile printing and dyeing, in particular to a method for preparing yarn with cloud dyeing effect; dyes with more than one color are mixed, and a small amount of dispersing agent is added, so that the pigment is not completely uniformly mixed, and the yarn obtained by extrusion molding of the pigment mixed spinning raw material has a randomly distributed multi-color cloud dyeing effect, and the cloud dyeing yarn with multi-color cloud dyeing effect is prepared, and compared with the cloth blank prepared by the traditional single-color yarn, the prepared cloth blank has a more three-dimensional pattern effect.

10 Claims, No Drawings

METHOD FOR PREPARING YARN WITH CLOUD DYEING EFFECT

CROSS REFERENCE TO RELATED APPLICATIONS

The present application is a Continuation Application of PCT Application No. PCT/CN2018/087198 filed on Oct. 8, 2018, the contents of which are incorporated herein by reference in their entirety.

TECHNICAL FIELD

The invention relates to the technical field of textile printing and dyeing, in particular to a method for preparing yarn with cloud dyeing effect.

BACKGROUND ART

Chemical fibers are fibers with a textile property which are prepared by using artificially synthesized high-molecular compound as raw materials through the processes of preparing spinning solution, spinning, post-treatment and the like; the existing chemical fiber dyeing technology mainly comprises a tow dyeing method, a solution dyeing method and a gel dyeing method; the Chinese patent with the Publication No. CN1403640A relates to a solution dyeing method in which a dye or pigment is added to a high molecular compound (spinning raw material) and a colored fiber is directly manufactured by using an existing wet spinning process. However, the colored yarn manufactured with the traditional solution dyeing process generally has a uniform single color, and it is difficult to achieve the cloud dyeing effect of multi-color mixing.

SUMMARY OF THE INVENTION

The technical problem to be solved by the present invention is that: the invention provides a method for preparing yarn with cloud dyeing effect based on solution dyeing method, which can achieve a multicolor mixing effect.

In order to solve the technical problem, the technical scheme adopted by the invention is as follows: the invention provides a method for preparing yarn with cloud dyeing effect, which comprises the following steps:

- step 1: putting a spinning raw material into a spinning box, and heating the spinning box to enable the spinning raw material to be in a molten state;
- step 2: mixing dyes with more than one color, and adding a dispersing agent with 0.1-0.5% of a total mass of the dyes to obtain a dye mixed liquor;
- step 3: pouring dye mixed liquor obtained in step 2 into the spinning box, mixing the liquor with the spinning raw material in a molten state, and extruding through a spinneret orifice to form a melt fine stream; and
- step 4: cooling and solidifying melt fine stream obtained in step 3 to form nascent fiber, and oil winding the nascent fiber to obtain cloud dyeing yarn.

The beneficial effects of the present invention are: in the method for preparing yarn with cloud dyeing effect provided by the present invention, dyes with more than one color are mixed, and a small amount of dispersing agent is added, so that the pigment is not completely uniformly mixed, and the yarn obtained by extrusion molding of the pigment mixed spinning raw material has a randomly distributed multi-color cloud dyeing effect, and the cloud dyeing yarn with multi-color cloud dyeing effect is prepared, and compared with the cloth blank prepared by the traditional single-color yarn, the prepared cloth blank has a more three-dimensional pattern effect. According to the traditional printing and dyeing process, a large amount of water needs to be used, a large amount of waste water needs to be treated and a large number of resources and costs are consumed. The cloth blank prepared by using the cloud dyeing yarn prepared according to the invention does not need later printing and dyeing so that the energy-saving and environment-friendly effect is achieved.

DETAILED DESCRIPTION OF THE INVENTION

In order to explain the technical content, achieved object, and effect of the present invention in detail, reference is made to the following preferred embodiments.

The key idea of the invention is as follows: dyes with more than one color are mixed and a very small amount of dispersing agent is added so that the pigment is not completely uniformly mixed, and the yarn obtained by extrusion molding of the pigment mixed spinning raw material has a randomly distributed multicolor cloud dyeing effect.

The invention provides a method for preparing yarn with cloud dyeing effect, which comprises the following steps:

- step 1: putting a spinning raw material into a spinning box, and heating the spinning box to enable the spinning raw material to be in a molten state;
- step 2: mixing dyes with more than one color, and adding a dispersing agent with 0.1-0.5% of the total mass of the dyes to obtain a dye mixed liquor;
- step 3: pouring the dye mixed liquor obtained in step 2 into the spinning box, mixing the liquor with the spinning raw material in a molten state, and extruding through a spinneret orifice to form a melt fine stream; and step 4: cooling and solidifying the melt fine stream obtained in step 3 to form nascent fiber, and oil winding the nascent fiber to obtain the cloud dyeing yarn.

According to the method for preparing yarn with cloud dyeing effect, dyes with more than one color are mixed, and a small amount of dispersing agent is added, so that the pigment is not completely uniformly mixed, and the yarn obtained by extrusion molding of the pigment mixed spinning raw material has a randomly distributed multi-color cloud dyeing effect, and the cloud dyeing yarn with multi-color cloud dyeing effect is prepared, and compared with the cloth blank prepared by the traditional single-color yarn, the prepared cloth blank has a more three-dimensional pattern effect. According to the traditional printing and dyeing process, a large amount of water needs to be used, a large amount of waste water needs to be treated and a large number of resources and costs are consumed. The cloth blank prepared by using the cloud dyeing yarn prepared according to the invention does not need later printing and dyeing so that the energy-saving and environment-friendly effect is achieved.

Further, in the method for preparing yarn with cloud dyeing effect, the spinning raw material is at least one of polyester fiber, polypropylene fiber, polyethylene fiber, polyacrylonitrile fiber, polyamide fiber, polyvinyl alcohol fiber, and aramid fiber.

Further, in the method for preparing yarn with cloud dyeing effect, the spinning raw material is prepared by the following steps:

wrapping the surface of the natural fiber with a silicone resin coating and drying; and mixing the natural fiber wrapped with the silicone resin coating and chemical fiber to prepare the spinning raw material.

A mixture of natural fiber and chemical fiber is selected as the spinning raw material, and a silicone resin coating is wrapped on the surface of the natural fiber so that the structure of the natural fiber is not damaged in a high-temperature spinning environment. The cloud dyeing yarn prepared by the method has the advantages of quick drying of the chemical fiber, light weight, and excellent tactile impression of the natural fiber.

Further, in the method for preparing yarn with cloud dyeing effect, after step 4, the method further comprises the following steps:

step 5: washing the cloud dyeing yarn obtained in step 4 with water to remove the silicone resin coating wrapped on the surface of the natural fiber.

Further, in the method for preparing yarn with cloud dyeing effect, the linear density of the natural fiber is 0.1-10 DTex.

Further, in the method for preparing yarn with cloud dyeing effect, the linear density of the natural fiber is 0.5-5 DTex.

Further, in the method for preparing yarn with cloud dyeing effect, the length of the natural fiber is 10-30 mm.

Further, in the method for preparing yarn with cloud dyeing effect, the length of the natural fiber is 23-30 mm.

By optimizing the length and density of the natural fiber, when the natural fiber and the chemical fiber are mixed and extruded, the natural fiber is exposed to the outside, so that the blended product has an excellent tactile impression of the natural fiber, and the blended product is made into clothes, shoes or caps more comfortable to wear.

Further, in the method for preparing yarn with cloud dyeing effect, step 1 specifically comprises:

step 1: putting the spinning raw material into the spinning box, and heating the spinning box to 200-300° C. to enable the polymer to be in a molten state.

Further, in the method for preparing yarn with cloud dyeing effect, step 2 specifically comprises:

step 2: mixing dyes of 2-3 colors, and adding a dispersing agent of 0.3% of the total mass of the dye to obtain a dye mixed liquor.

Embodiment 1

A method for preparing yarn with cloud dyeing effect comprises the following steps:

step 1: putting the spinning raw material into the spinning box, and heating the spinning box to 200° C. to enable the polymer to be in a molten state;

step 2: mixing dyes with more than one color, and adding a dispersing agent with 0.1% of the total mass of the dyes to obtain a dye mixed liquor;

step 3: pouring the dye mixed liquor obtained in step 2 into the spinning box, mixing the liquor with the spinning raw material in a molten state, and extruding through a spinneret orifice to form a melt fine stream; and step 4: cooling and solidifying the melt fine stream obtained in step 3 to form nascent fiber, and oil winding the nascent fiber to obtain the cloud dyeing yarn.

The spinning raw material is at least one of polyester fiber, polypropylene fiber, polyethylene fiber, polyacrylonitrile fiber, polyamide fiber, polyvinyl alcohol fiber, and aramid fiber.

Embodiment 2

A method for preparing yarn with cloud dyeing effect comprises the following steps:

step 1: putting the spinning raw material into the spinning box, and heating the spinning box to 300° C. to enable the polymer to be in a molten state;

step 2: mixing dyes of 3 colors, and adding a dispersing agent of 0.5% of the total mass of the dyes to obtain a dye mixed liquor;

step 3: pouring the dye mixed liquor obtained in step 2 into the spinning box, mixing the liquor with the spinning raw material in a molten state, and extruding through a spinneret orifice to form a melt fine stream; and step 4: cooling and solidifying the melt fine stream obtained in step 3 to form nascent fiber, and oil winding the nascent fiber to obtain the cloud dyeing yarn.

The spinning raw material is at least one of polyester fiber, polypropylene fiber, polyethylene fiber, polyacrylonitrile fiber, polyamide fiber, polyvinyl alcohol fiber, and aramid fiber.

Embodiment 3

A method for preparing yarn with cloud dyeing effect comprises the following steps:

step 1: putting the spinning raw material into the spinning box, and heating the spinning box to 200° C. to enable the polymer to be in a molten state;

wherein the spinning raw material is prepared by the following steps:

wrapping the surface of the natural fiber with a silicone resin coating and drying;

mixing the natural fiber wrapped with the silicone resin coating and chemical fiber to prepare the spinning raw;

the linear density of the natural fiber being 0.1 DTex; the length of the natural fiber being 10 mm;

step 2: mixing dyes of 2 colors, and adding a dispersing agent of 0.5% of the total mass of the dyes to obtain a dye mixed liquor;

step 3: pouring the dye mixed liquor obtained in step 2 into the spinning box, mixing the liquor with the spinning raw material in a molten state, and extruding through a spinneret orifice to form a melt fine stream;

step 4: cooling and solidifying the melt fine stream obtained in step 3 to form nascent fiber, and oil winding the nascent fiber to obtain the cloud dyeing yarn; and step 5: washing the cloud dyeing yarn obtained in step 4 with water to remove the silicone resin coating wrapped on the surface of the natural fiber.

Embodiment 4

A method for preparing yarn with cloud dyeing effect comprises the following steps:

step 1: putting the spinning raw material into the spinning box, and heating the spinning box to 200° C. to enable the polymer to be in a molten state;

wherein the spinning raw material is prepared by the following steps:

wrapping the surface of the natural fiber with a silicone resin coating and drying;

mixing the natural fiber wrapped with the silicone resin coating and chemical fiber to prepare the spinning raw;

the linear density of the natural fiber being 10 DTex; the length of the natural fiber being 30 mm;

step 2: mixing dyes of 2 colors, and adding a dispersing agent of 0.3% of the total mass of the dyes to obtain a dye mixed liquor;

step 3: pouring the dye mixed liquor obtained in step 2 into the spinning box, mixing the liquor with the spinning raw material in a molten state, and extruding through a spinneret orifice to form a melt fine stream;

step 4: cooling and solidifying the melt fine stream obtained in step 3 to form nascent fiber, and oil winding the nascent fiber to obtain the cloud dyeing yarn; and step 5: washing the cloud dyeing yarn obtained in step 4 with water to remove the silicone resin coating wrapped on the surface of the natural fiber.

Embodiment 5

A method for preparing yarn with cloud dyeing effect comprises the following steps:

step 1: putting the spinning raw material into the spinning box, and heating the spinning box to 200° C. to enable the polymer to be in a molten state;

wherein the spinning raw material is prepared by the following steps:

wrapping the surface of the natural fiber with a silicone resin coating and drying;

mixing the natural fiber wrapped with the silicone resin coating and chemical fiber to prepare the spinning raw;

the linear density of the natural fiber being 0.5 DTex; the length of the natural fiber being 23 mm;

step 2: mixing dyes of 2 colors, and adding a dispersing agent of 0.3% of the total mass of the dyes to obtain a dye mixed liquor;

step 3: pouring the dye mixed liquor obtained in step 2 into the spinning box, mixing the liquor with the spinning raw material in a molten state, and extruding through a spinneret orifice to form a melt fine stream;

step 4: cooling and solidifying the melt fine stream obtained in step 3 to form nascent fiber, and oil winding the nascent fiber to obtain the cloud dyeing yarn; and step 5: washing the cloud dyeing yarn obtained in step 4 with water to remove the silicone resin coating wrapped on the surface of the natural fiber.

Embodiment 6

A method for preparing yarn with cloud dyeing effect comprises the following steps:

step 1: putting the spinning raw material into the spinning box, and heating the spinning box to 200° C. to enable the polymer to be in a molten state;

wherein the spinning raw material is prepared by the following steps:

wrapping the surface of the natural fiber with a silicone resin coating and drying;

mixing the natural fiber wrapped with the silicone resin coating and chemical fiber to prepare the spinning raw;

the linear density of the natural fiber being 5 DTex; the length of the natural fiber being 30 mm;

step 2: mixing dyes of 2 colors, and adding a dispersing agent of 0.3% of the total mass of the dyes to obtain a dye mixed liquor;

step 3: pouring the dye mixed liquor obtained in step 2 into the spinning box, mixing the liquor with the spinning raw material in a molten state, and extruding through a spinneret orifice to form a melt fine stream;

step 4: cooling and solidifying the melt fine stream obtained in step 3 to form nascent fiber, and oil winding the nascent fiber to obtain the cloud dyeing yarn; and step 5: washing the cloud dyeing yarn obtained in step 4 with water to remove the silicone resin coating wrapped on the surface of the natural fiber.

In summary, in the method for preparing yarn with cloud dyeing effect provided by the invention, dyes with more than one color are mixed, and a small amount of dispersing agent is added, so that the pigment is not completely uniformly mixed, and the yarn obtained by extrusion molding of the pigment mixed spinning raw material has a randomly distributed multi-color cloud dyeing effect, and the cloud dyeing yarn with multi-color cloud dyeing effect is prepared, and compared with the cloth blank prepared by the traditional single-color yarn, the prepared cloth blank has a more three-dimensional pattern effect. According to the traditional printing and dyeing process, a large amount of water needs to be used, a large amount of waste water needs to be treated and a large number of resources and costs are consumed. The cloth blank prepared by using the cloud dyeing yarn prepared according to the invention does not need later printing and dyeing so that the energy-saving and environment-friendly effect is achieved.

The above descriptions are merely embodiments of the invention and are not intended to limit the scope of the invention. All equivalent transformations made by using the contents of the description of the present invention, or directly or indirectly applied in related technical fields, are similarly included in the protection scope of the present invention.

What is claimed is:

1. A method for preparing yarn with cloud dyeing effect, characterized by comprising the following steps:

step 1: putting a spinning raw material into a spinning box, and heating the spinning box to enable the spinning raw material to be in a molten state;

step 2: mixing dyes with more than one color, and adding a dispersing agent with 0.1-0.5% of a total mass of the dyes to obtain a dye mixed liquor;

step 3: pouring dye mixed liquor obtained in step 2 into the spinning box, mixing the liquor with the spinning raw material in a molten state, and extruding through a spinneret orifice to form a melt fine stream; and step 4: cooling and solidifying melt fine stream obtained in step 3 to form nascent fiber, and oil winding the nascent fiber to obtain cloud dyeing yarn.

2. The method for preparing yarn with cloud dyeing effect according to claim 1, characterized in that the spinning raw material is at least one of polyester fiber, polypropylene fiber, polyethylene fiber, polyacrylonitrile fiber, polyamide fiber, polyvinyl alcohol fiber, and aramid fiber.

3. The method for preparing yarn with cloud dyeing effect according to claim 1, characterized in that the spinning raw material is prepared by the following steps:

wrapping a surface of a natural fiber with a silicone resin coating and drying; and mixing the natural fiber wrapped with the silicone resin coating and chemical fiber to prepare the spinning raw material.

4. The method for preparing yarn with cloud dyeing effect according to claim 3, characterized by further comprising a following step after step 4:

step 5: washing the cloud dyeing yarn obtained in step 4 with water to remove the silicone resin coating wrapped on the surface of the natural fiber.

5. The method for preparing yarn with cloud dyeing effect according to claim 3, characterized in that the natural fiber has a linear density of 0.1-10 DTex.

6. The method for preparing yarn with cloud dyeing effect according to claim 3, characterized in that the natural fiber has a linear density of 0.5-5 DTex.

7. The method for preparing yarn with cloud dyeing effect according to claim 3, characterized in that the natural fiber has a length of 10-30 mm.

8. The method for preparing yarn with cloud dyeing effect according to claim 3, characterized in that the natural fiber has a length of 23-30 mm.

9. The method for preparing yarn with cloud dyeing effect according to claim 1, characterized in that wherein said step 1, putting the spinning raw material into the spinning box, and heating the spinning box to 200-300° C. to enable the polymer to be in a molten state.

10. The method for preparing yarn with cloud dyeing effect according to claim 1, characterized in that wherein said step 2, mixing dyes of 2-3 colors, and adding a dispersing agent of 0.3% of the total mass of the dye to obtain a dye mixed liquor.

* * * * *